US006733372B2

(12) United States Patent
Lin

(10) Patent No.: US 6,733,372 B2
(45) Date of Patent: May 11, 2004

(54) GRINDING MACHINE HAVING ADJUSTABLE MECHANISM

(76) Inventor: Kun Yi Lin, No. 104, Lane 145, Song Ju Road, Bei Tun, Taichung (TW), 406

( * ) Notice: Subject to any disclaimer, the term of this patent is extended or adjusted under 35 U.S.C. 154(b) by 148 days.

(21) Appl. No.: 10/079,277

(22) Filed: Feb. 21, 2002

(65) Prior Publication Data

US 2003/0157871 A1 Aug. 21, 2003

(51) Int. Cl.[7] ..... B24B 7/28

(52) U.S. Cl. ..... 451/65; 451/310; 451/311; 451/361

(58) Field of Search ..... 451/296, 65, 303, 451/66, 310, 139, 311, 236, 361, 360

(56) References Cited

U.S. PATENT DOCUMENTS 1,437,414 A * 12/1922 Gruenhagen ..... 451/310
2,470,615 A * 5/1949 Grover ..... 451/311
2,857,717 A * 10/1958 Edgemond, Jr. et al. .... 451/310
3,538,650 A * 11/1970 Pollack ..... 451/297
5,168,656 A * 12/1992 Jolly et al. ..... 451/310
5,199,220 A * 4/1993 Steiner et al. ..... 451/65
6,468,140 B1 * 10/2002 Wang ..... 451/310
6,533,649 B2 * 3/2003 Wang ..... 451/310

* cited by examiner

*Primary Examiner*—Timothy V. Eley
(74) *Attorney, Agent, or Firm*—Charles E. Baxley

(57) ABSTRACT

A grinding machine includes a work table disposed on top of a base, a housing rotatably secured to the base with a shaft and having a roller disposed on one end, a casing has one end secured to the housing and has another roller, a sander belt is engaged over the rollers. The sander belt is adjustable relative to the base and the work table when the housing is rotated and adjusted relative to the base about the shaft. A plate is secured to the base and has a curved slot, the casing has a fastener adjustably engaged in the curved slot of the plate.

13 Claims, 13 Drawing Sheets

GRINDING MACHINE HAVING ADJUSTABLE MECHANISM

BACKGROUND OF THE INVENTION

1. Field of the Invention

The present invention relates to a grinding machine, and more particularly to a grinding machine having an easily and conveniently adjustable mechanism.

2. Description of the Prior Art

Typical grinding machines comprise a work table for supporting the work pieces, and a sander belt driven by a motor and disposed closer to the work table or the work pieces for grinding the work pieces. An adjustable guiding plate is disposed on the work table for engaging with and for adjusting the work piece relative to the sander belt. Normally, the sander belt may not be adjusted relative to the work table or relative to the work pieces.

The present invention has arisen to mitigate and/or obviate the afore-described disadvantages of the conventional grinding machines.

SUMMARY OF THE INVENTION

The primary objective of the present invention is to provide a grinding machine including an easily and conveniently adjustable mechanism.

In accordance with one aspect of the invention, there is provided a grinding machine comprising a base including a work table provided on top thereof, a housing rotatably secured to the base with a shaft for allowing the housing to be rotated and adjusted relative to the base, and including a first roller provided thereon, a casing including a first end secured to the housing and rotated in concert with the housing relative to the base, a second roller provided on the casing, a sander belt engaged over the first and the second rollers, and means for driving the sander belt. The sander belt is adjustable relative to the base and the work table when the housing is rotated and adjusted relative to the base about the shaft.

The driving means includes a motor secured to the casing and having a spindle coupled to the second roller.

The base includes a plate secured thereto and having a curved slot formed therein, the casing includes a fastener slidably and adjustably engaged in the curved slot of the plate, for adjustably securing the casing and thus the housing to the base at the selected angular position.

A device is further provided for vibrating the casing and thus the second roller and the sander belt relative to the base and the work table and includes a vibrating device secured to the casing and having an eccentric pin coupled to the housing, for allowing the casing to be vibrated relative to the housing and the base when the eccentric pin is rotated relative to the vibrating device.

The housing includes at least one guide column disposed therein, a bracket slidably engaged on the at least one guide column for supporting the first roller, and movable toward and away from the second roller.

A device is further provided for adjusting the bracket relative to the housing and includes a link secured to the bracket, a hand grip rotatably secured to the housing, and a crank coupling the hand grip to the link for moving the link and the bracket relative to the housing and for adjusting the first roller relative to the second roller.

Another device is further provided for biasing the bracket and the first roller away from the second roller.

An additional table support is further provided and includes a panel having a rod extended therefrom and secured to the bracket, and a sander wheel secured to the first roller. A box is secured on the panel, and includes an opening formed therein for receiving the sander wheel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
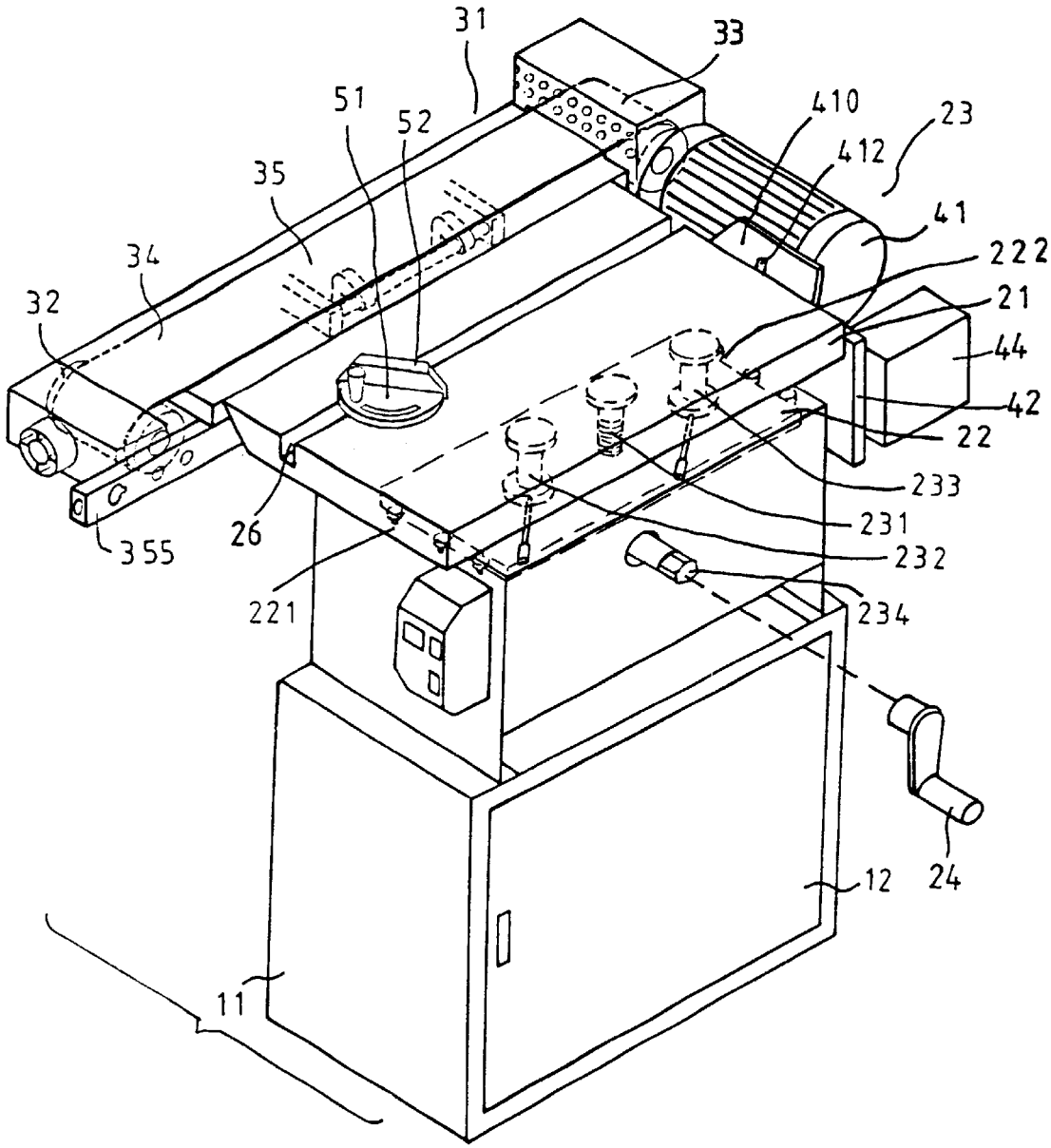
FIG. 1 is a partial exploded view of a grinding machine in accordance with the present invention.
Figure 2:
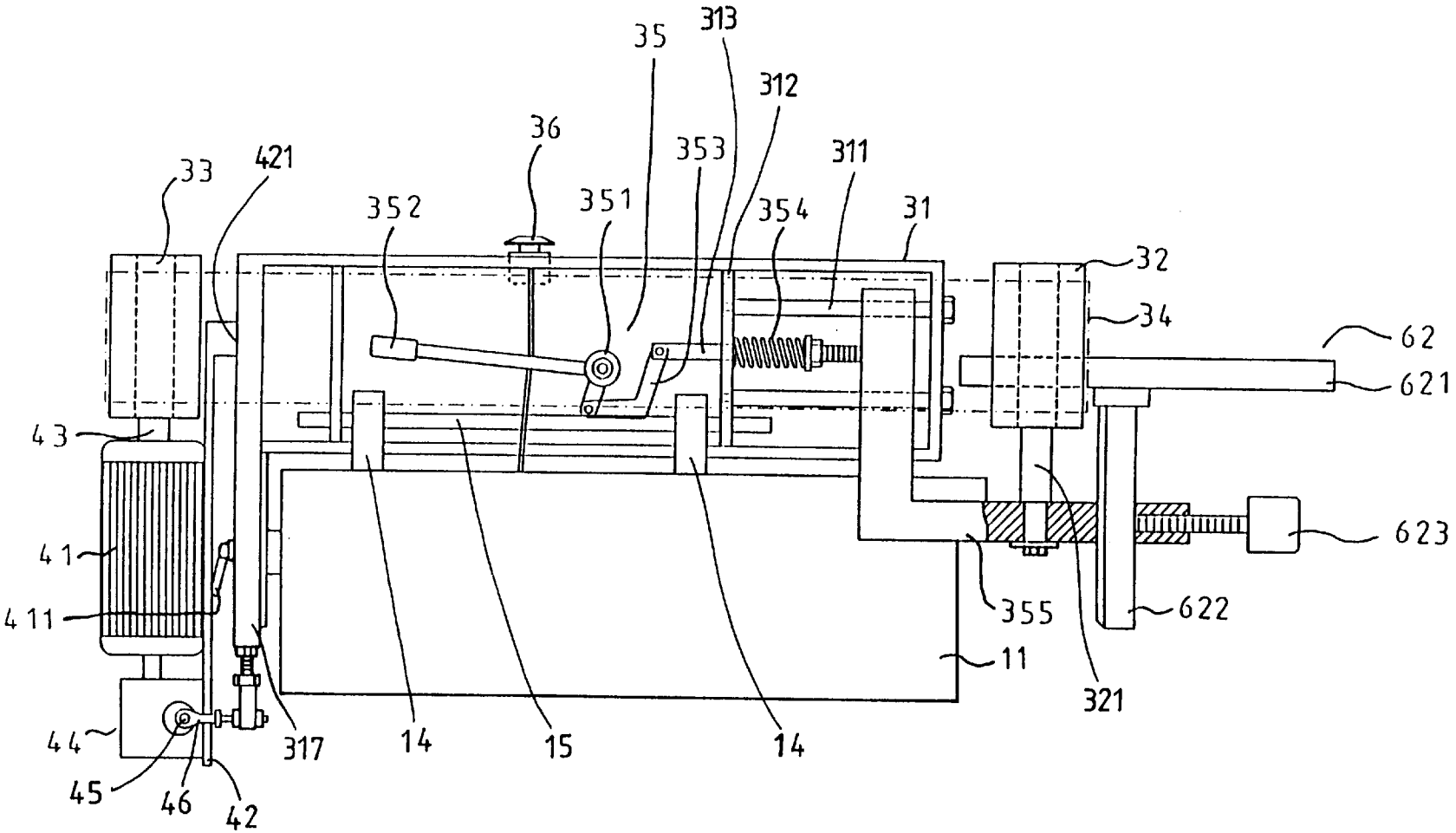
FIG. 2 is a bottom plan schematic view of the grinding machine.
Figure 3:
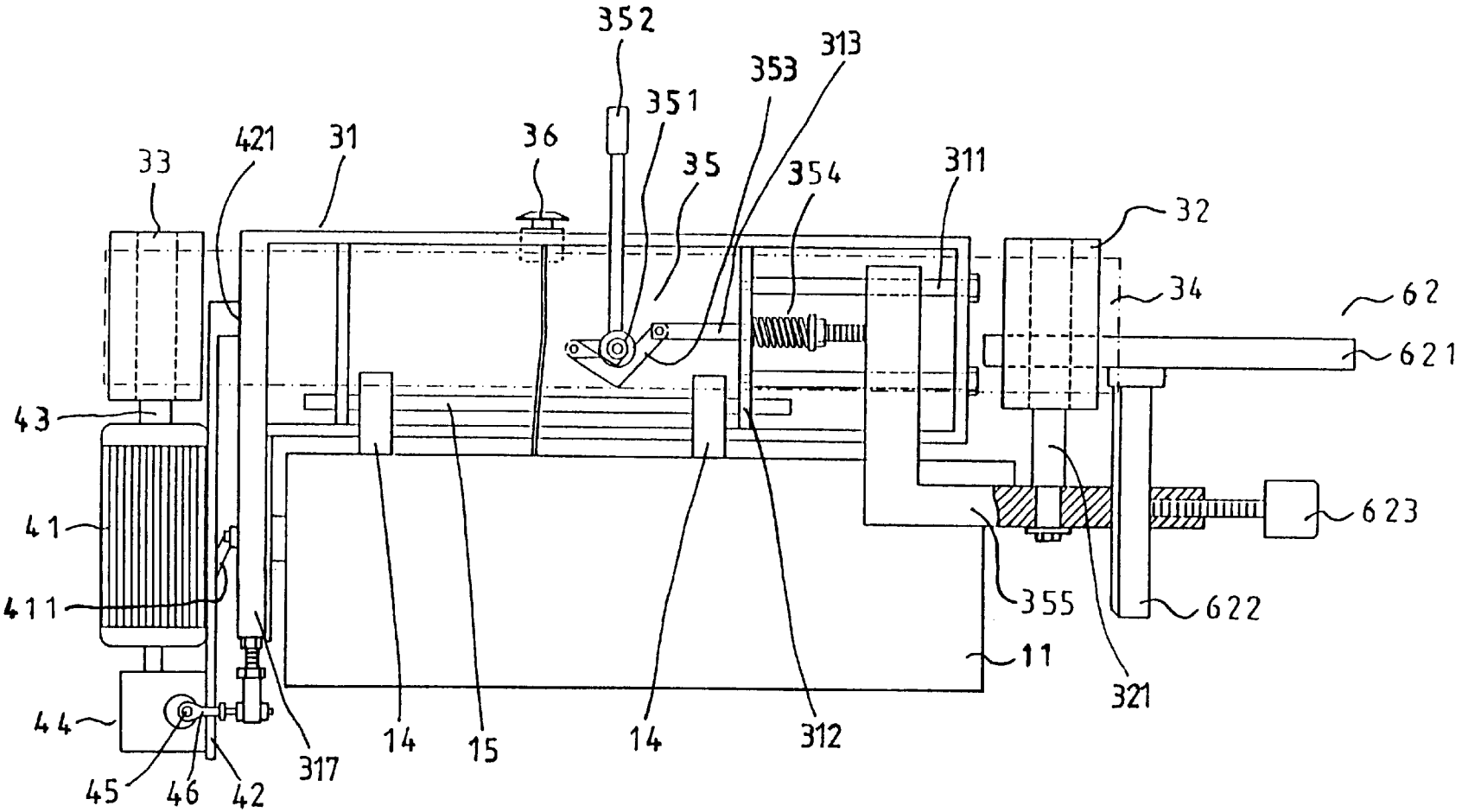
FIG. 3 is a bottom plan schematic view of the grinding machine, similar to FIG. 2, illustrating the attachment of the sander belt onto the wheels or rollers.

Referring to the drawings, and initially to FIGS. 1–3, a grinding machine in accordance with the present invention comprises a base 11 including a cabinet 12 provided therein for receiving or storing various kinds of work tools or tool members etc. A board 22 is slidably supported on top of the base 11 with one or more bearings 221, 222, for allowing the board 22 to be moved forward and rearward relative to the base 11. A work table 21 is provided above the board 22. One or more, such as two guide posts 232, 233 are secured to the bottom of the work table 21 and extended downward therefrom and slidably engaged through the board 22. A bolt 231 has an upper end secured to the bottom of the work table 21 and extended downward through the board 22. The base 11 may include one or more channels (not shown) formed therein for slidably receiving the guide posts 232, 233 and the bolt 231, for allowing the board 22 and the work table 21 to be moved forward and rearward relative to the base 11.

A pole 234 is laterally and rotatably received in the upper portion of the base 11, and includes one end engaged with the bolt 231 with such as a worm or worm gear (not shown), which is typical and will not be described in further details. A handle 24 is secured to the pole 234 for rotating the pole 234 and thus for rotating the bolt 231, in order to move the work table 21 upward and downward relative to the board 22 and the base 11. The work table 21 includes a channel 26 formed in the upper portion thereof. A typical protractor type bracket 51 is slidably and adjustably secured on the work table 21 and adjustable along the channel 26 of the work table 21, and includes one or more baffle 52 for engaging with the work pieces and for adjusting the work pieces relative to the work table 21.

Figure 4:
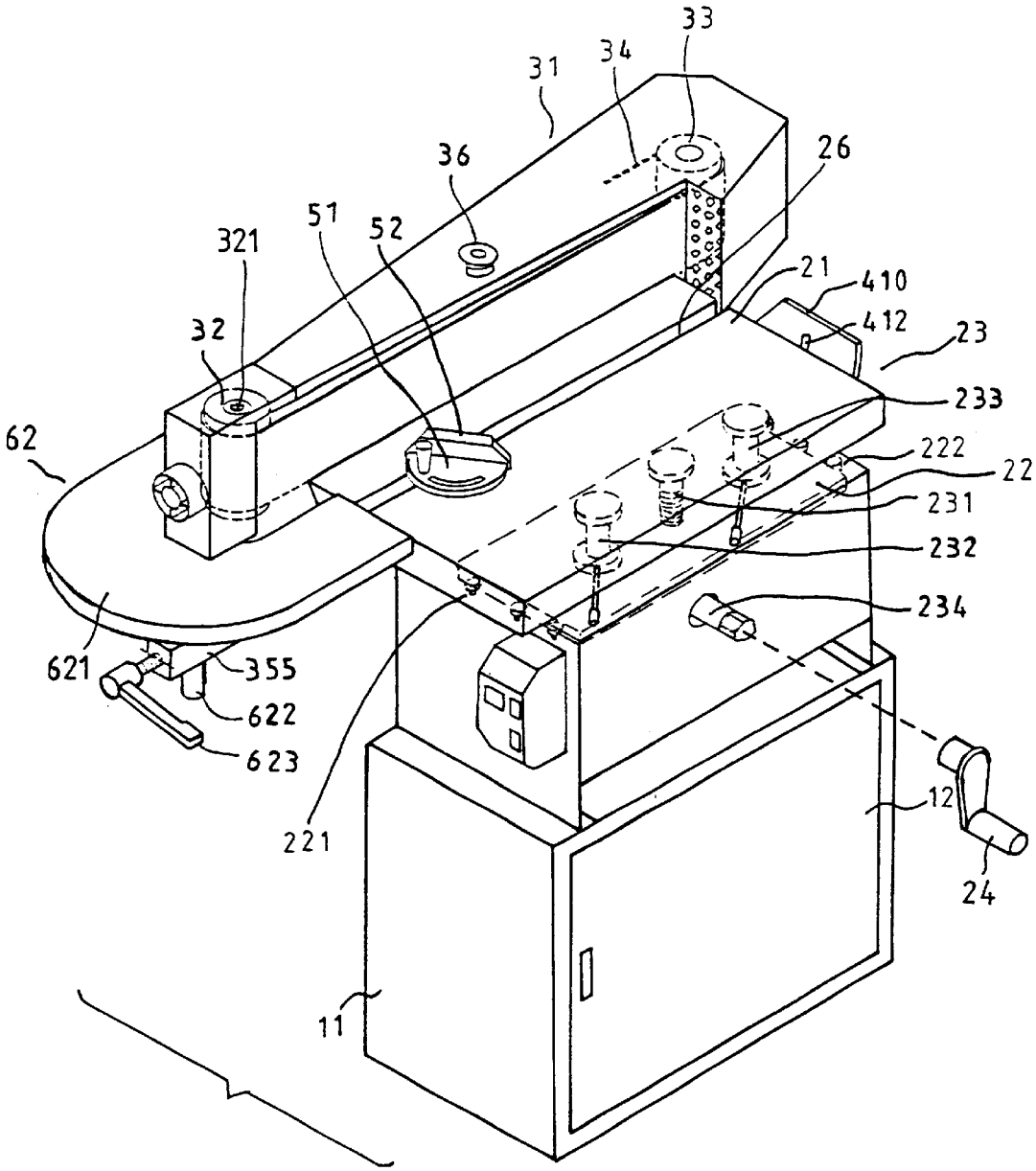
FIGS. 4, 5 are partial exploded views similar to FIG. 2, illustrating the adjustment or the operation of the grinding machine.
Figure 5:
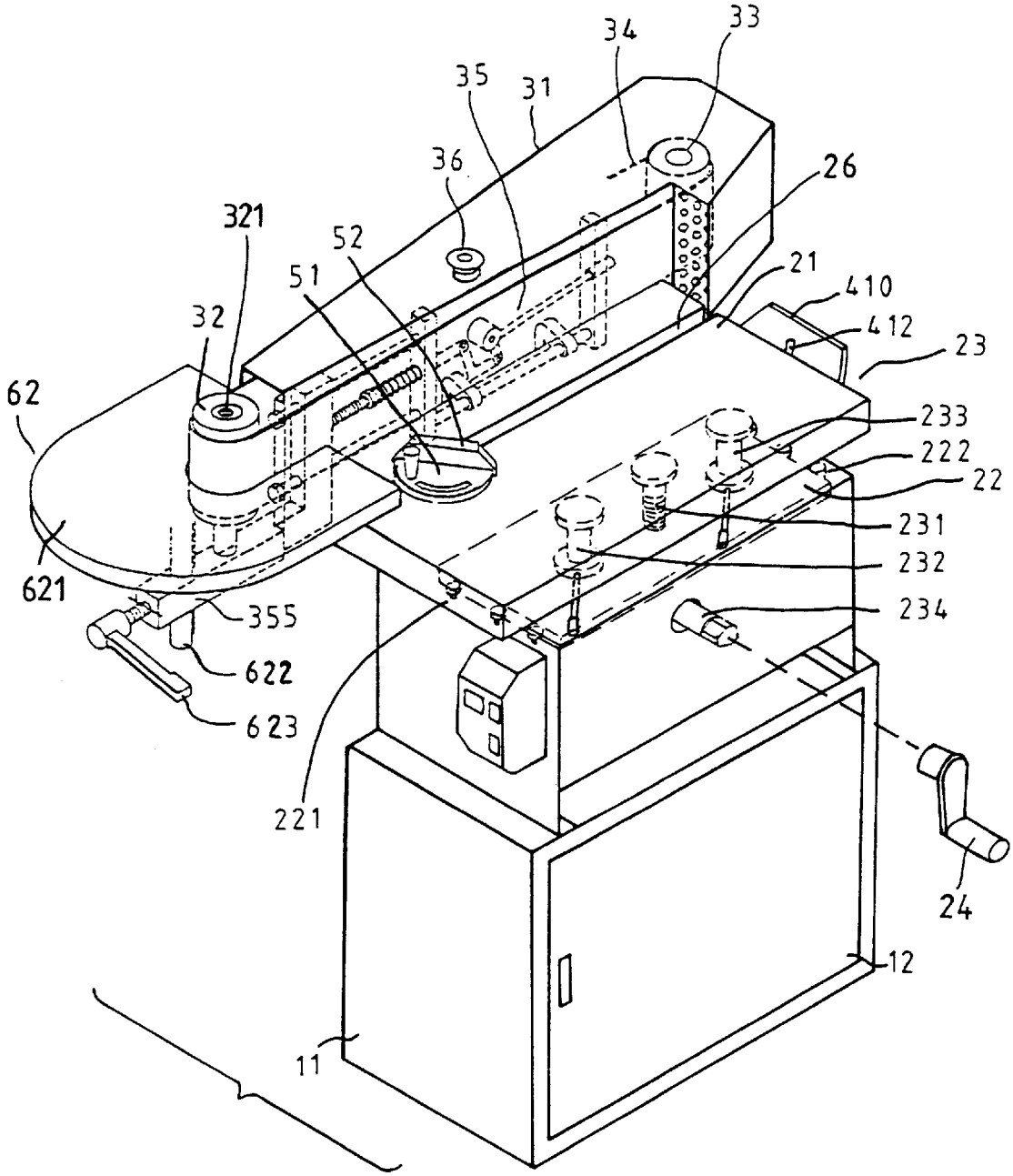
Figure 7:
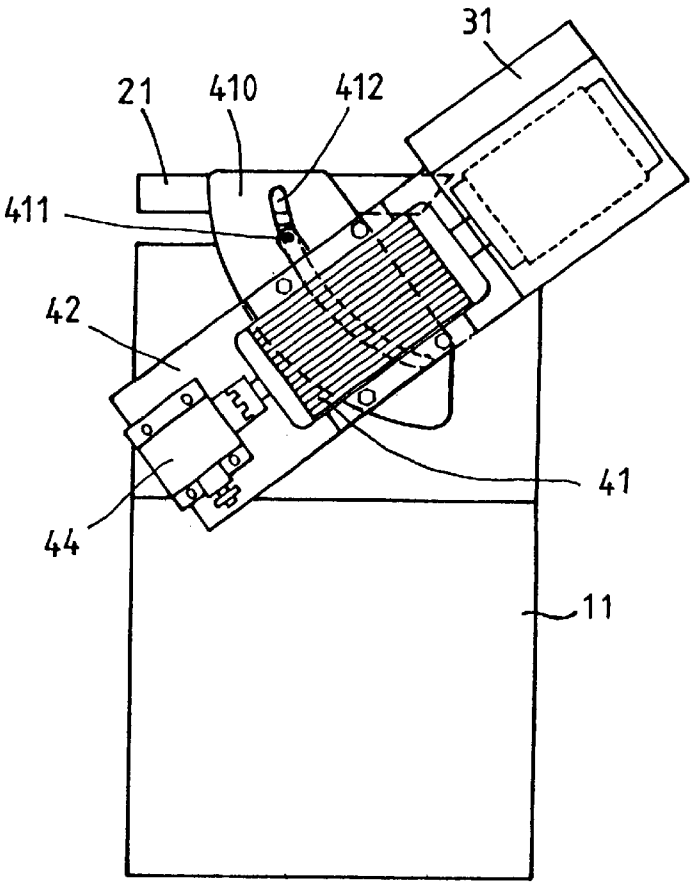
FIGS. 6, 7, 8, 9, 10, 11, 12, 13 are side plan schematic views illustrating the adjustment or the operation of the grinding machine.
Figure 6:
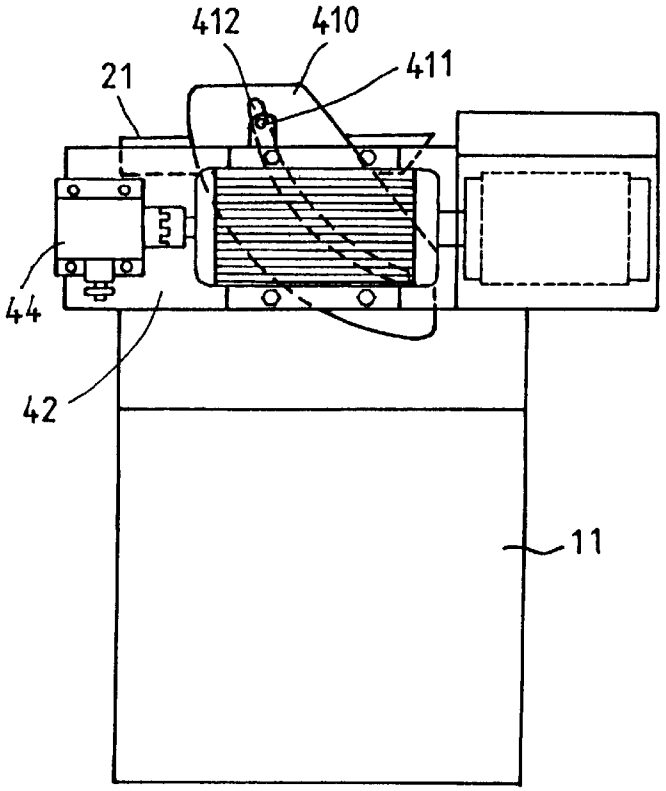
Figure 8:
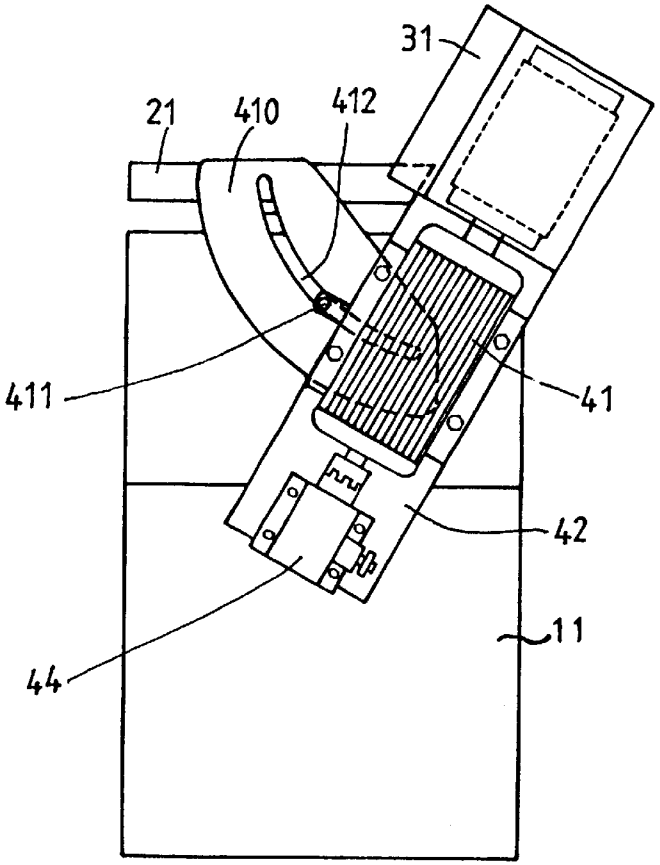
Figure 9:
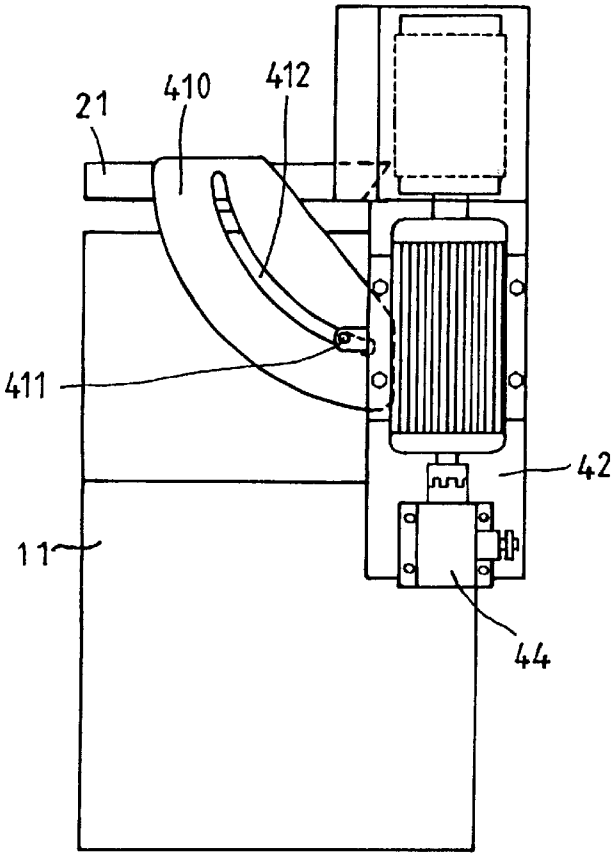
Figure 10:
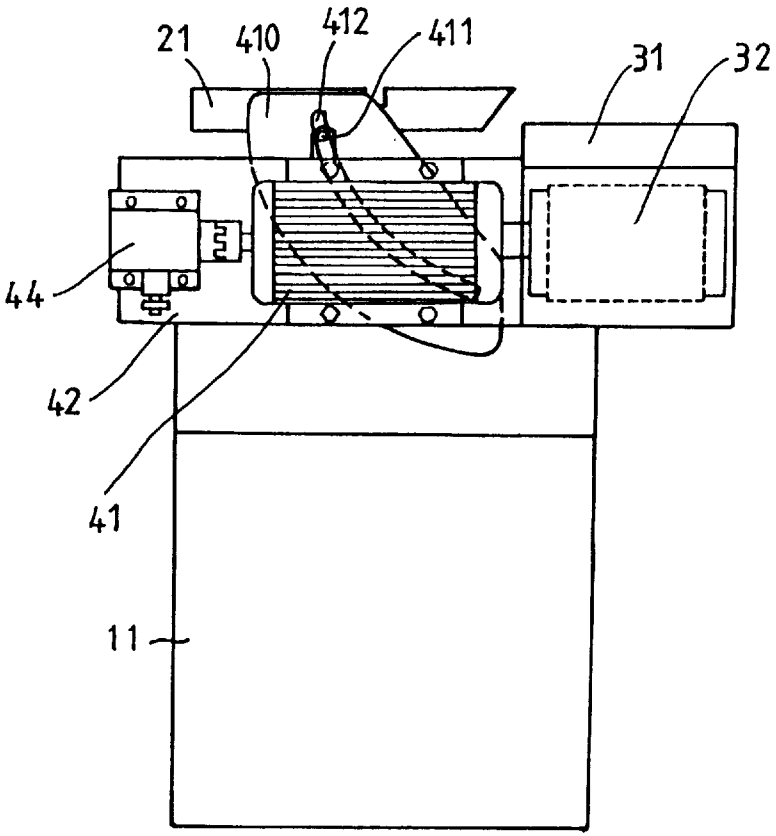
Figure 11:
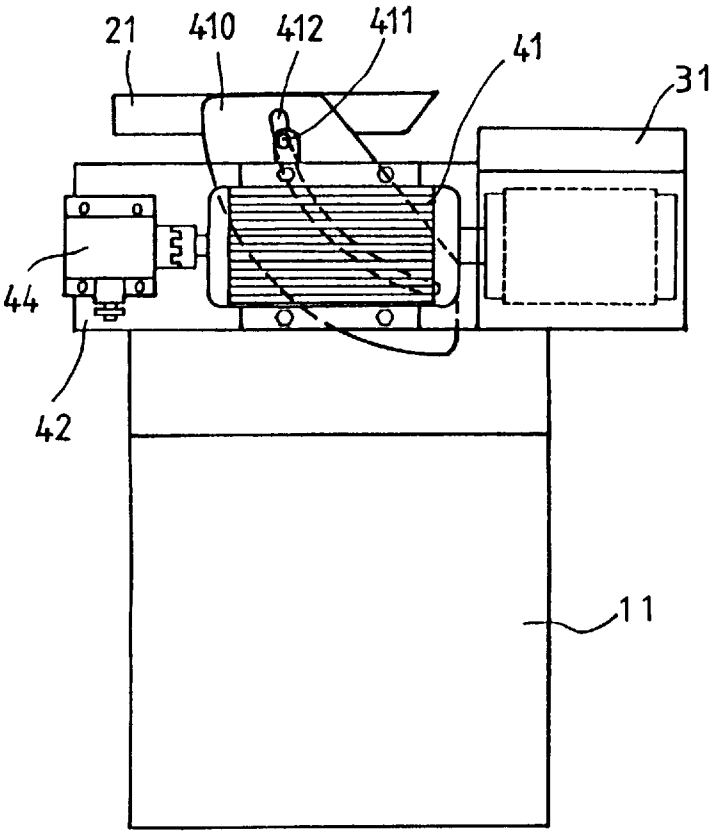
Figure 12:
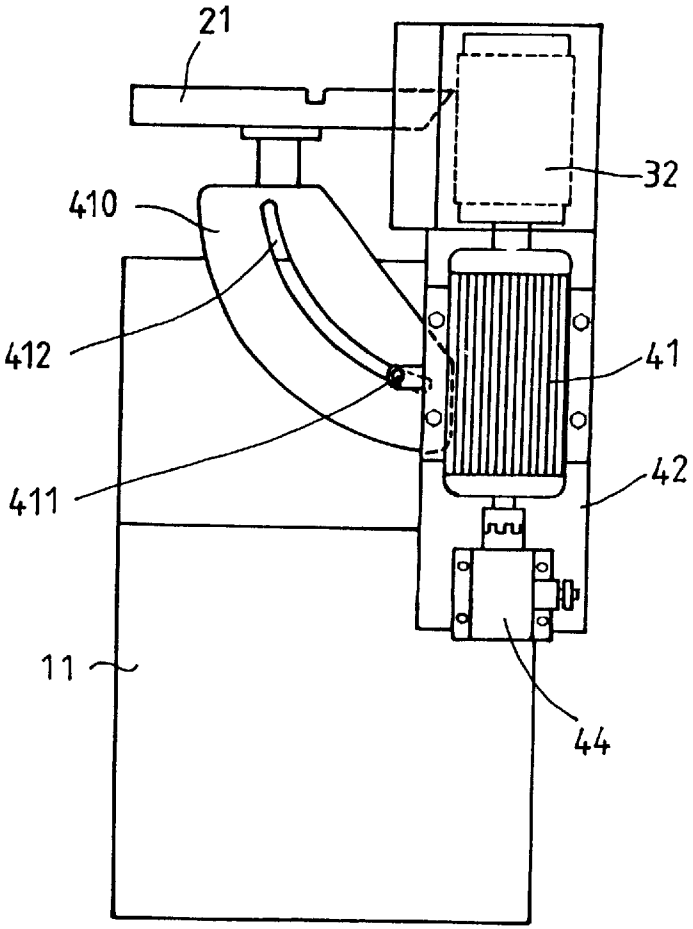
Figure 13:
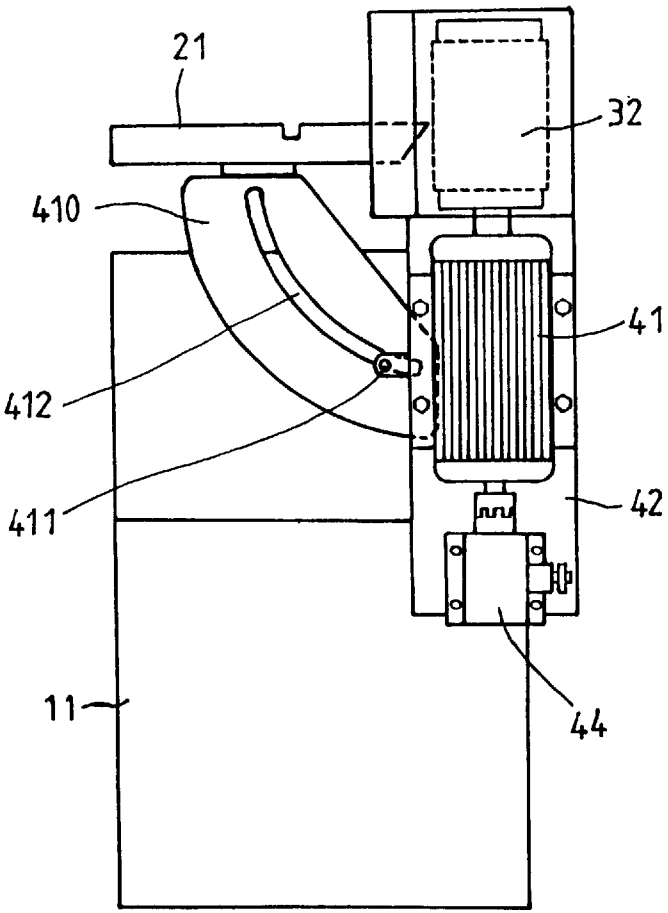

The base 11 includes a pair of ears 14 extended rearward therefrom for rotatably supporting a shaft 15 therein (FIGS. 2, 3). A housing 31 is rotatably secured to the base 11 with the shaft 15, for allowing the housing 31 to be adjusted relative to the work table 21 between a horizontal position parallel to the work table 21 (FIG. 1), and a vertical position vertical to the work table 21 (FIGS. 4, 5). The base 11 includes a plate 410 attached to one side thereof and having a curved slot 412 formed therein. A casing 42 has one end secured to the housing 31 with one or more fasteners 421, for allowing the casing 42 to be rotated in concert with the housing 31 and to be adjusted relative to the base 11 to any suitable angular position (FIGS. 6–13). The casing 42 includes a fastener 411 slidably and adjustably engaged in the curved slot 412 of the plate 410, for adjustably securing the casing 42 to the base 11 at any suitable or selected angular positions.

Referring again to FIGS. 2 and 3, a motor 41 is secured to the casing 42, and includes a spindle 43 extended therefrom. A wheel or a roller 33 is secured to the spindle 43 and rotated and driven by the motor 41. The housing 31 includes one or more guide columns 311 provided therein, and includes a partition 312 provided therein for supporting the guide columns 311. A bracket 355 is slidably secured on the guide columns 311 and movable and adjustable relative to the housing 31 along the guide columns 311. A link 313 is slidably engaged through the partition 312 and secured to the bracket 355 and moved in concert with the bracket 355. Another wheel or roller 32 has an axle 321 rotatably secured to the bracket 355 and adjustable relative to the housing 31 and the roller 33 for allowing an endless grinder belt or sander belt 34 to be engaged over the rollers 32, 33. A spring 354 is engaged on the link 313 and biased against the bracket 355 for biasing the bracket 355 and thus the roller 32 away from the roller 33 in order to stretch and tighten the sander belt 34 on the rollers 32, 33.

A hand grip 352 includes one end pivotally secured to the housing 31 with a pivot joint 351, and coupled to the link 313 with a crank or a lever 353. The hand grip 352 may move the link 313 and thus the bracket 355 and the roller 32 toward the roller 33 when the hand grip 352 is rotated outward of the housing 31 (FIG. 3), such that the sander belt 34 may be easily engaged over the rollers 32, 33 and may be replaced with the other ones. When the hand grip 352 is rotated inward of the housing 31 (FIGS. 2, 18), the roller 32 may be moved away from the roller 33 in order to stretch and tighten the sander belt 34 on the rollers 32, 33. The spring 354 may also bias the roller 32 away from the roller 33 to facilitate the stretching and tightening of the sander belt 34 on the rollers 32, 33. The housing 31 may include an emergency switch 36 provided thereon (FIGS. 2–5) for stop the grinding machine when any emergency conditions occur.

Figure 15:
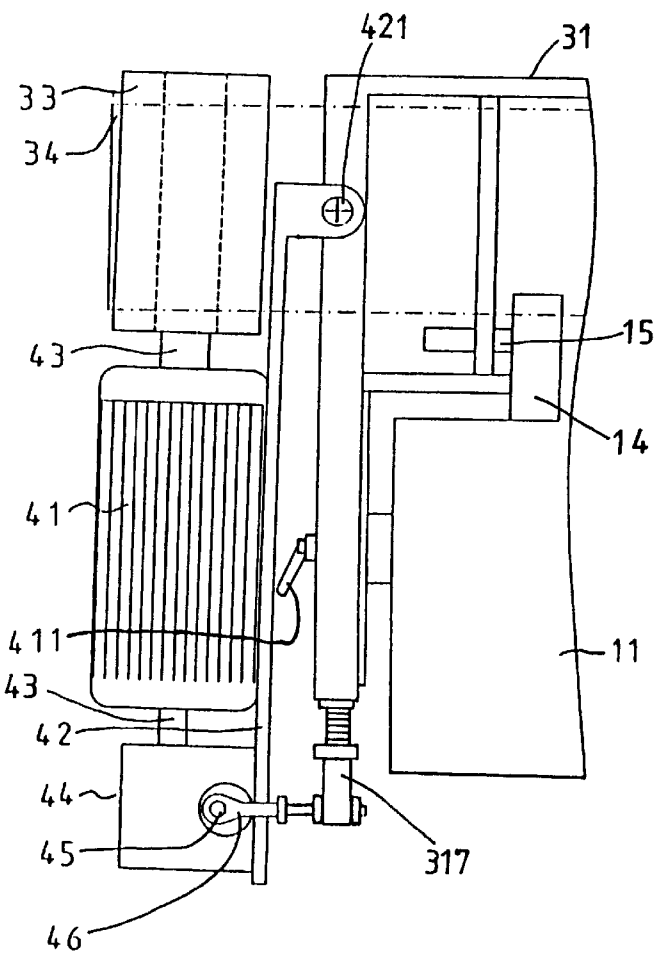
FIGS. 14, 15 are partial bottom plan schematic views, illustrating the vibrating device for the sander belt.
Figure 14:
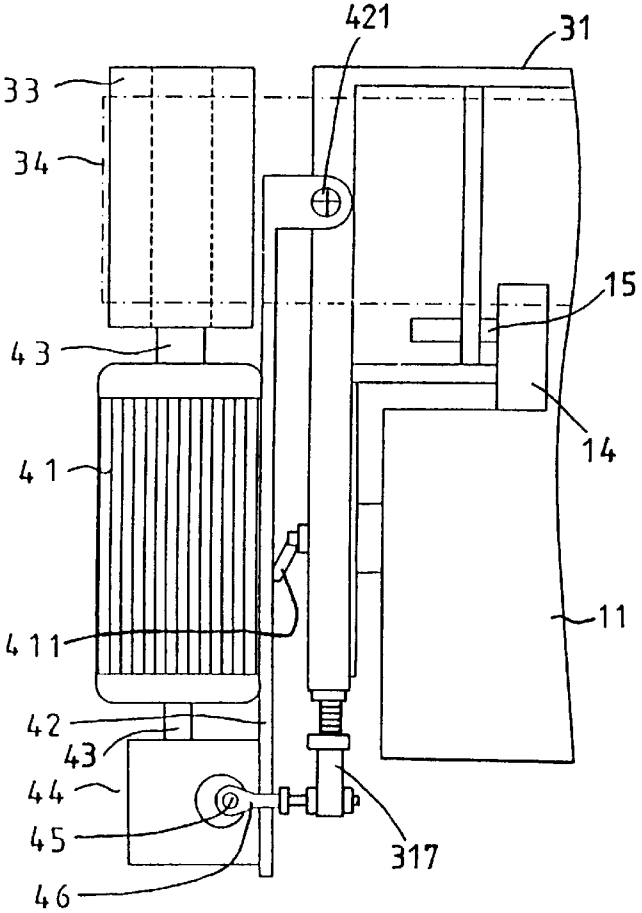

Referring next to FIGS. 14, 15, a vibrating device 44 is secured to the casing 42, and coupled to the spindle 43 of the motor 41 so as to be rotated and driven by the motor 41, and includes an eccentric pin 45 extended therefrom, and coupled to the housing 31 or an extension 317 of the housing 31 with such as a bar 46. The casing 42 may thus be caused to vibrate relative to the base 11, in order to vibrate or fluctuate or oscillate the sander belt 34 relative to the roller 33, for allowing the sander belt 34 to be adjustably engaged onto the work pieces, and for preventing the sander belt from engaging onto the work pieces with the same and relatively smaller portions.

Figure 16:
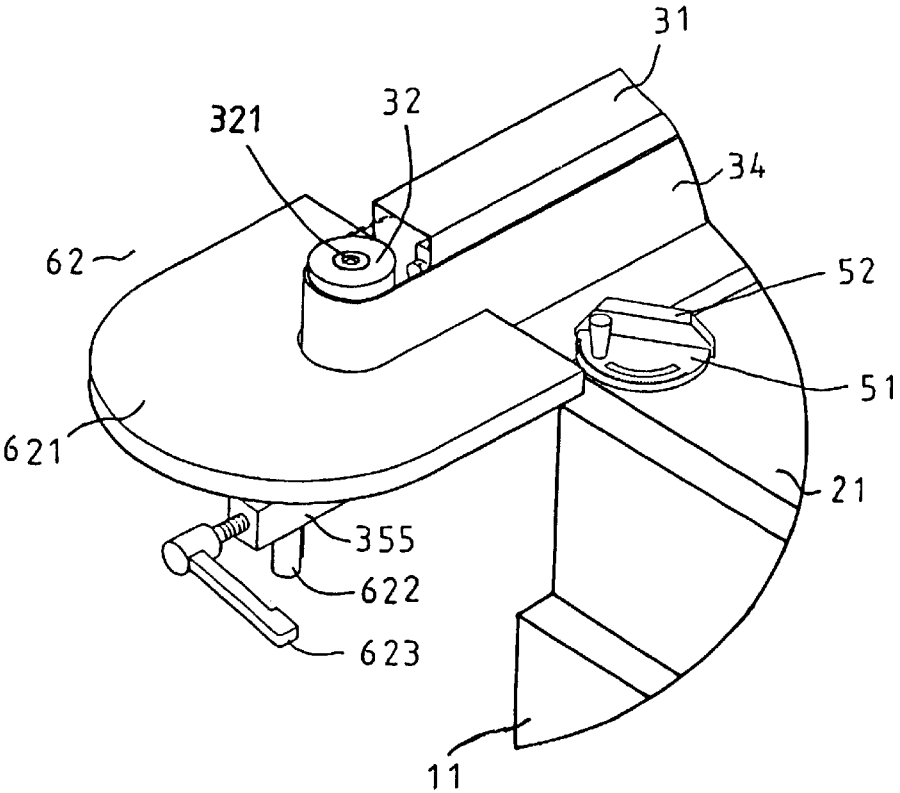
FIGS. 16, 17 are partial perspective views illustrating the attachment of an additional work table to the base of the grinding machine.
Figure 17:
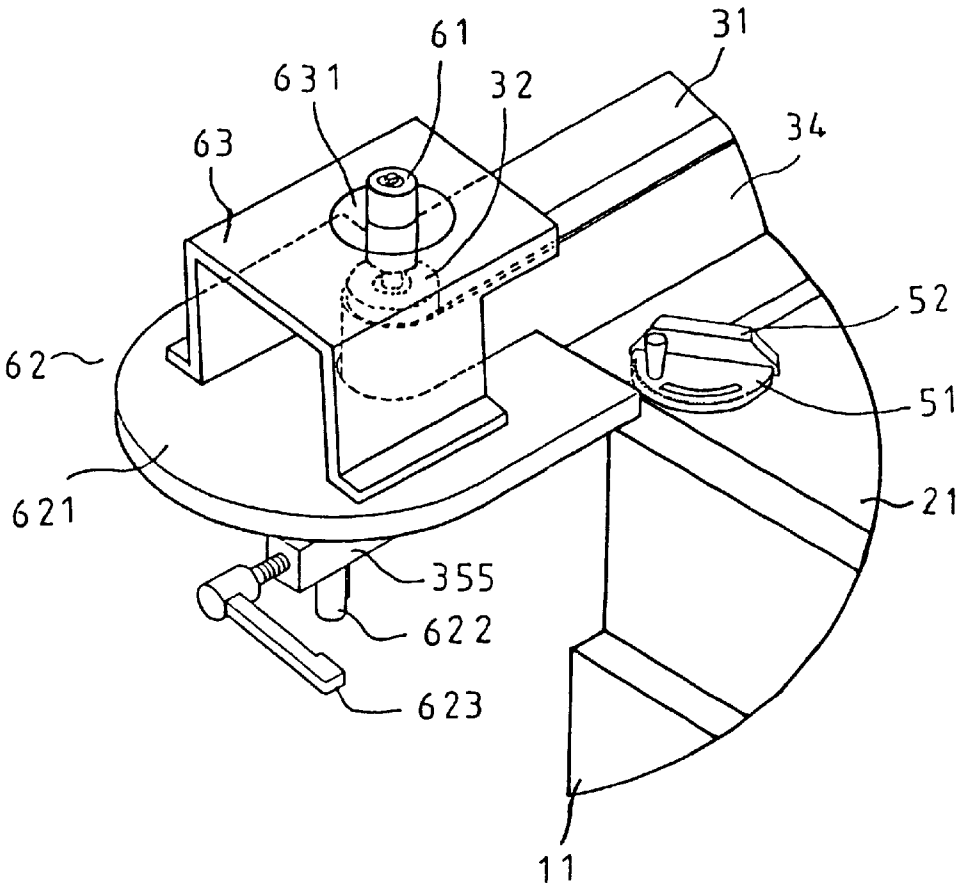
Figure 18:
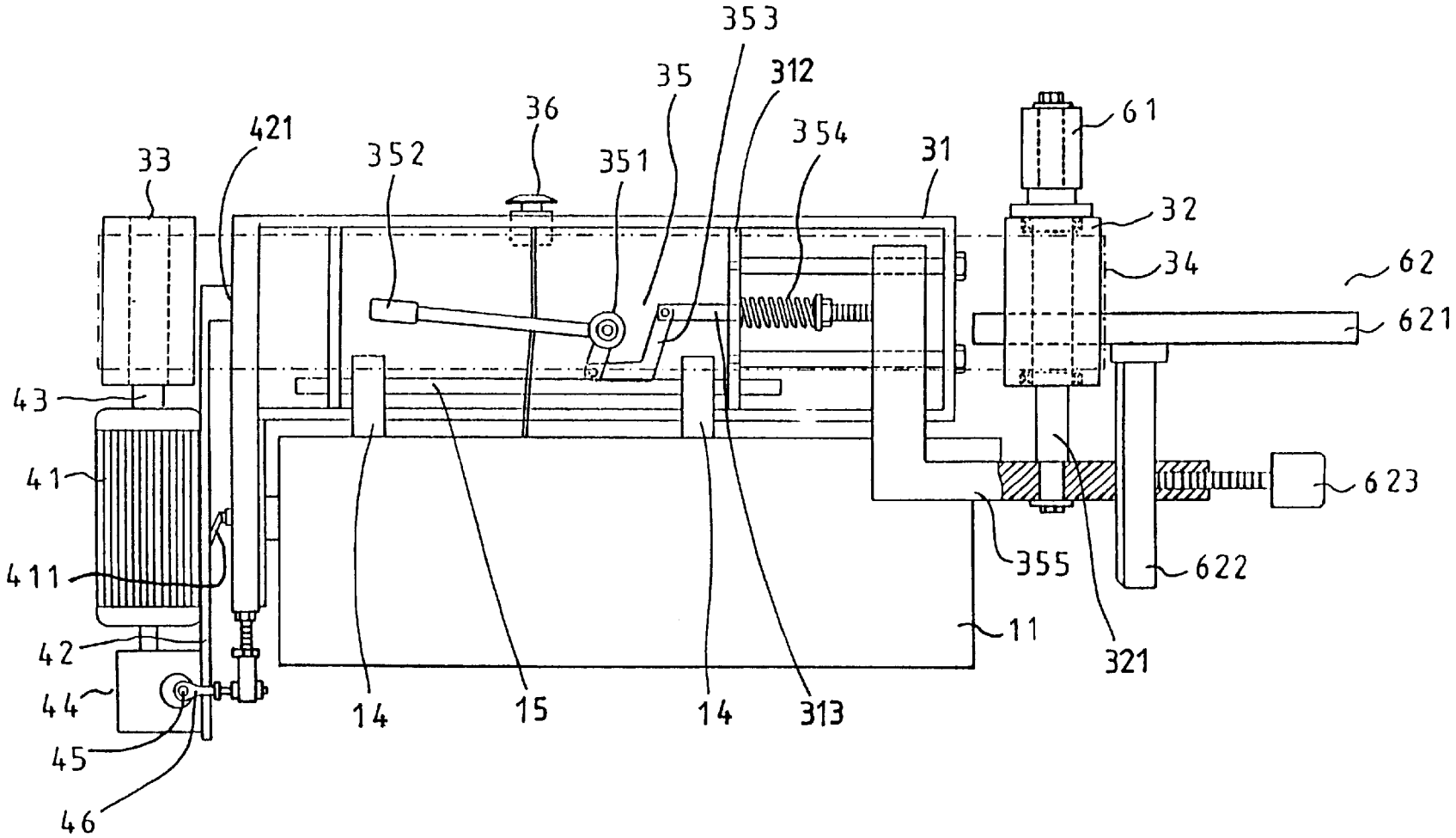
FIG. 18 is a bottom plan schematic view similar to FIGS. 2 and 3, illustrating the other application of the grinding machine.

Referring next to FIGS. 16–18, and again to FIGS. 1–5, an additional table support 62 includes a panel 621 disposed beside the roller 32 and having a rod 622 extended therefrom and slidably engaged through the bracket 355. A fastener 623 may secure the rod 622 to the bracket 355 after the panel 621 has been adjusted relative to the sander belt 34 to the required positions. An additional sander roller or wheel 61 is secured to the axle 321 of the roller 32 (FIGS. 17, 18). A box 63 is secured on top of the panel 621 and includes an opening 631 formed therein for receiving the sander wheel 61 which may be used for grinding or sanding the inner peripheral surfaces of the work pieces.

Accordingly, the grinding machine in accordance with the present invention includes an easily and conveniently adjustable mechanism.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A grinding machine comprising:

a base including a work table provided on top thereof, said base including a plate secured thereto and having a curved slot formed therein, a housing rotatably secured to said base with a shaft for allowing said housing to be rotated and adjusted relative to said base, and including a first roller provided thereon, a casing including a first end secured to said housing and rotated in concert with said housing relative to said base, said casing including a fastener slidably and adjustably engaged in said curved slot of said plate, for adjustably securing said casing and thus said housing to said base at the selected angular position, a second roller provided on said casing, a sander belt engaged over said first and said second rollers, and means for driving said sander belt, said sander belt being adjustable relative to said base and said work table when said housing is rotated and adjusted relative to said base about said shaft.

2. The grinding machine according to claim 1, wherein said driving means includes a motor secured to said casing and having a spindle coupled to said second roller.

3. The grinding machine according to claim 1 further comprising means for vibrating said casing and thus said second roller and said sander belt relative to said base and said work table.

4. The grinding machine according to claim 1 further comprising means for adjusting said bracket relative to said housing.

5. The grinding machine according to claim 4, wherein said adjusting means includes a link secured to said bracket, a hand grip rotatably secured to said housing, and a crank coupling said hand grip to said link for moving said link and said bracket relative to said housing and for adjusting said first roller relative to said second roller.

6. A grinding machine comprising:

a base including a work table provided on top thereof, a housing rotatably secured to said base with a shaft for allowing said housing to be rotated and adjusted relative to said base, and including a first roller provided thereon, a casing including a first end secured to said housing and rotated in concert with said housing relative to said base, a second roller provided on said casing, a sander belt engaged over said first and said second rollers, means for driving said sander belt, said sander belt being adjustable relative to said base and said work table when said housing is rotated and adjusted relative to said base about said shaft, and means for vibrating said casing and thus said second roller and said sander belt relative to said base and said work table, said vibrating means including a vibrating device secured to said casing and having an eccentric pin coupled to said housing, for allowing said casing to be vibrated relative to said housing and said base when said eccentric pin is rotated relative to said vibrating device.

7. A grinding machine comprising:

a base including a work table provided on top thereof, a housing rotatably secured to said base with a shaft for allowing said housing to be rotated and adjusted relative to said base, and including a first roller provided thereon, a casing including a first end secured to said housing and rotated in concert with said housing relative to said base, a second roller provided on said casing, a sander belt engaged over said first and said second rollers, means for driving said sander belt, said sander belt being adjustable relative to said base and said work table when said housing is rotated and adjusted relative to said base about said shaft, and said housing including at least one guide column disposed therein, a bracket slidably engaged on said at least one guide column for supporting said first roller, and movable toward and away from said second roller.

8. The grinding machine according to claim 7 further comprising means for biasing said bracket and said first roller away from said second roller.

9. The grinding machine according to claim 7 further comprising an additional table support including a panel having a rod extended therefrom and secured to said bracket.

10. The grinding machine according to claim 9 further comprising a sander wheel secured to said first roller.

11. The grinding machine according to claim 10 further comprising a box secured on said panel, and including an opening formed therein for receiving said sander wheel.

12. A grinding machine comprising:

a base including a work table provided on top thereof, a housing rotatably secured to said base with a shaft for allowing said housing to be rotated and adjusted relative to said base, and including a first roller provided thereon, a casing including a first end secured to said housing and rotated in concert with said housing relative to said base, a second roller provided on said casing, a sander belt engaged over said first and said second rollers, means for driving said sander belt, said sander belt being adjustable relative to said base and said work table when said housing is rotated and adjusted relative to said base about said shaft, and said first roller being secured to said housing with an axle, said grinding machine further includes a sander wheel secured to said axle of said first roller.

13. The grinding machine according to claim 12 further comprising a bracket secured to said housing, an additional table support including a panel having a rod extended therefrom and secured to said bracket, a box secured on said panel and including an opening formed therein for receiving said sander wheel.

* * * * *